US008205749B2

(12) United States Patent
Korpanty et al.

(10) Patent No.: US 8,205,749 B2
(45) Date of Patent: Jun. 26, 2012

(54) STACKABLE FLEXIBLE CONTAINER ASSEMBLY

(75) Inventors: Lawrence Korpanty, York, PA (US); Kevin D. Himes, Mount Wolf, PA (US); John E. Denner, York, PA (US); David B. Clements, Medina, OH (US)

(73) Assignee: Graham Packaging Company, L.P., York, PA (US)

( * ) Notice: Subject to any disclaimer, the term of this patent is extended or adjusted under 35 U.S.C. 154(b) by 972 days.

(21) Appl. No.: 12/177,248

(22) Filed: Jul. 22, 2008

(65) Prior Publication Data

US 2010/0018889 A1 Jan. 28, 2010

(51) Int. Cl.
*B65D 21/036* (2006.01)
*B65D 1/00* (2006.01)

(52) U.S. Cl. ..... 206/508; 215/373; 220/721

(58) Field of Classification Search ..... 215/373, 215/376; 220/781, 721; 206/508
See application file for complete search history.

(56) References Cited

U.S. PATENT DOCUMENTS 3,429,475 A * 2/1969 Scholtz ..... 220/257.1
3,904,069 A * 9/1975 Toukmanian ..... 220/609
3,979,009 A * 9/1976 Walker ..... 220/609
4,120,419 A * 10/1978 Saunders ..... 220/609
4,381,061 A * 4/1983 Cerny et al. ..... 220/62.11
4,646,930 A * 3/1987 Karas et al. ..... 220/606
4,844,263 A * 7/1989 Hadtke ..... 206/508
5,593,063 A * 1/1997 Claydon et al. ..... 220/608
5,730,314 A * 3/1998 Wiemann et al. ..... 220/609
5,823,382 A * 10/1998 Van Giezen et al. ..... 220/571
7,169,418 B2 1/2007 Dalton et al.
2003/0221987 A1* 12/2003 Trude ..... 206/508
2004/0211746 A1* 10/2004 Trude ..... 215/374
2008/0298938 A1* 12/2008 Melrose ..... 414/293

* cited by examiner

*Primary Examiner* — Mickey Yu
*Assistant Examiner* — Niki Eloshway
(74) *Attorney, Agent, or Firm* — Knoble Yoshida & Dunleavy, LLC

(57) ABSTRACT

A stackable container assembly that is particularly suited for packaging heavy bulk products such as paint includes a container having a main body and a removable lid having an upstanding rim portion that has an upper surface. The container has a flexible bottom portion that has a lower surface that includes at least one support surface for supporting the container assembly on an underlying horizontal surface. The lower surface further includes at least one projection that is disposed radially inwardly from the support surface. The flexible bottom portion is advantageously configured so that the projection will flex radially downwardly and outwardly into a position that is adjacent to an upstanding rim portion of an underlying container assembly when the container assembly is stacked on top of another container assembly. This ensures accurate registration and positioning of the container assemblies during stacking.

11 Claims, 2 Drawing Sheets

STACKABLE FLEXIBLE CONTAINER ASSEMBLY

BACKGROUND OF THE INVENTION

1. Field of the Invention

This invention relates generally to the field of packaging bulk products such as paint, bulk chemicals or bulk foodstuffs. More specifically, this invention relates to an improved stackable container assembly that is configured to ensure accurate positioning and registration between respective container assemblies when they are stacked.

2. Description of the Related Technology

In the past, bulk substances such as paint, bulk chemicals such as granular chlorine or bulk foodstuffs such as grains or sugar were typically packaged using rigid metal containers. Recently, however, plastic containers have been introduced for use in such applications.

Plastic containers tend to be less expensive than metal containers, but are not as strong and are more prone to flexure than a metal container of comparable volume. Such flexure may occur as a result of internal pressure changes relative to ambient external pressure, or as a result of physical loads that are applied to the containers. One common physical load that is applied to containers is the vertical top load that is created when like containers are stacked on top of each other. When plastic containers are stacked, it is very important that each container be accurately centered with respect to the underlying container so that forces are evenly distributed on the contact surfaces and in the sidewall portions of the respective containers. Asymmetry during stacking can contribute to container failure, particularly when exacerbated by unwanted flexure that is caused by other factors. In addition, accurate centering during stacking is important for aesthetic reasons, especially in retail settings.

A need exists for an improved plastic container assembly that is configured so as to ensure accurate registration during stacking and so as to minimize unwanted container distortion that might otherwise occur as a result of relative pressure changes between the interior of the container and ambient conditions.

SUMMARY OF THE INVENTION

Accordingly, it is an object of the invention to provide an improved plastic container assembly that is configured so as to ensure accurate registration during stacking and so as to minimize unwanted container distortion that might otherwise occur as a result of relative pressure changes between the interior of the container and ambient conditions.

In order to achieve the above and other objects of the invention, a stackable container assembly that is constructed according to a first aspect of the invention includes a main body; an upstanding rim portion having an upper surface; and a flexible bottom portion, the flexible bottom portion having a lower surface comprising at least one support surface for supporting the container assembly on a horizontal surface, the lower surface further comprising at least one projection that is disposed radially inwardly from the support surface, and wherein the flexible bottom portion is configured so that the projection will flex downwardly into a position that is adjacent to an upstanding rim portion of an underlying container assembly when said container assembly is stacked on top of another container assembly.

According to a second aspect of the invention, a stackable container assembly includes a main body; an upstanding rim portion having an upper surface; and a flexible bottom portion, the flexible bottom portion having a lower surface comprising at least one support surface for supporting the container assembly on a horizontal surface, the lower surface further comprising at least one projection that is disposed radially inwardly from the support surface, and wherein the flexible bottom portion is configured so that the projection will flex radially outwardly into a position that is adjacent to an upstanding rim portion of an underlying container assembly when the container assembly is stacked on top of another container assembly.

A stackable container assembly according to a third aspect of the invention includes a main body; a removable lid portion, the removable lid portion comprising an upstanding rim portion having an upper surface, the removable lid portion further comprising a flexible diaphragm that is constructed and arranged to accommodate relative pressure changes between an interior of said container assembly and ambient conditions by flexing, whereby flexure of the rest of the container assembly as a result of such relative pressure changes is minimized; and a flexible bottom portion, the flexible bottom portion having a lower surface comprising at least one support surface for supporting said container assembly on a horizontal surface, the lower surface further comprising at least one projection that is disposed radially inwardly from the support surface, and wherein the flexible bottom portion is configured so that the projection will flex into a position that is adjacent to an upstanding rim portion of an underlying container assembly when the container assembly is stacked on top of another container assembly.

These and various other advantages and features of novelty that characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE PREFERRED EMBODIMENT(S)

Figure 1:
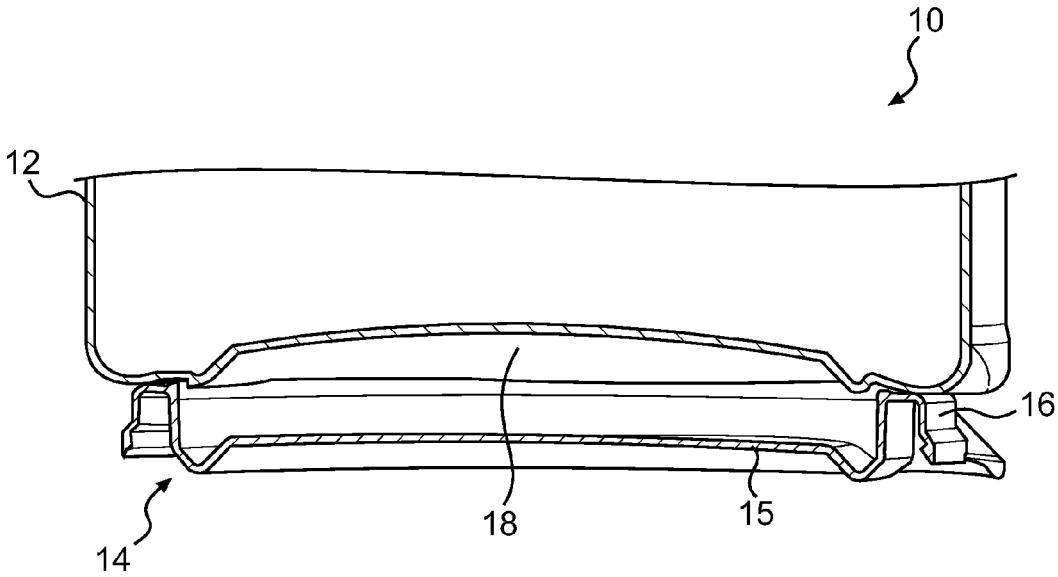
FIG. 1 is a fragmentary cross-sectional view depicting stacking of adjacent container assemblies that are constructed according to a preferred embodiment of the invention.

Referring now to the drawings, wherein like reference numerals designate corresponding structure throughout the views, and referring in particular to FIG. 1, a stackable container assembly 10 that is constructed according to a preferred embodiment of the invention includes a main body 12 and a removable lid portion 14 having an upstanding rim portion 16 that has an upper surface 17.

The removable lid portion 14 preferably has a flexible diaphragm 15 that is constructed and arranged to accommodate relative pressure changes between an interior of the container assembly 10 and ambient conditions by flexing. As a result, flexure of the rest of the container assembly 10 as a result of such relative pressure changes will be minimized.

The entire stackable container assembly 10 is preferably fabricated from a plastic material such as polyethylene or polypropylene. Alternatively, a portion of the stackable container assembly 10 could be constructed from a metallic material, while the rest of the container assembly is fabricated from a plastic material. For example, the removable lid portion 14 could be constructed from a metallic material such as steel.

Stackable container assembly 10 further preferably includes a flexible bottom portion 18 that has a lower surface 20 that defines at least one support surface 22 for supporting the container assembly 10 on a horizontal surface. In the preferred embodiment, support surface 22 is configured as an annular standing ring. Alternatively, however, support surface 22 could be constructed as a plurality of support feet, or other structure that is not continuous about the periphery of the flexible bottom portion 18.

Flexible bottom portion 18 is further configured so as to define at least one projection 24 that is disposed radially inwardly from the support surface 22. The flexible bottom portion 18 is constructed so that the projection 24 will flex downwardly and radially outwardly in response to the weight of material within the container into a position that is adjacent to the upstanding rim portion 16 of an underlying container assembly 10 when the container assembly 10 is stacked on top of another container assembly 10.

In the preferred embodiment of the invention, a plurality of projections 24 are provided. Specifically, four projections 24 that are discontinuous with respect to reach other are symmetrically provided within an annular area on the flexible bottom portion 18 that is positioned radially inwardly from the support surface 22. This contributes to ensuring secure and accurate registration of the container assemblies 10 during stacking, by providing secure guidance between the flexible bottom portion 18 of one container and the upstanding rim portion 16 of an underlying container. In the preferred embodiment, each projection 24 has a symmetrical counterpart position diametrically opposite on the other side of the flexible bottom portion 18. Alternatively, the projections could be asymmetrically positioned, such as may be the case if an odd number of projections were provided. Symmetrical positioning is preferred if there are an even number of projections. As few as two projections could be provided.

Figure 2:
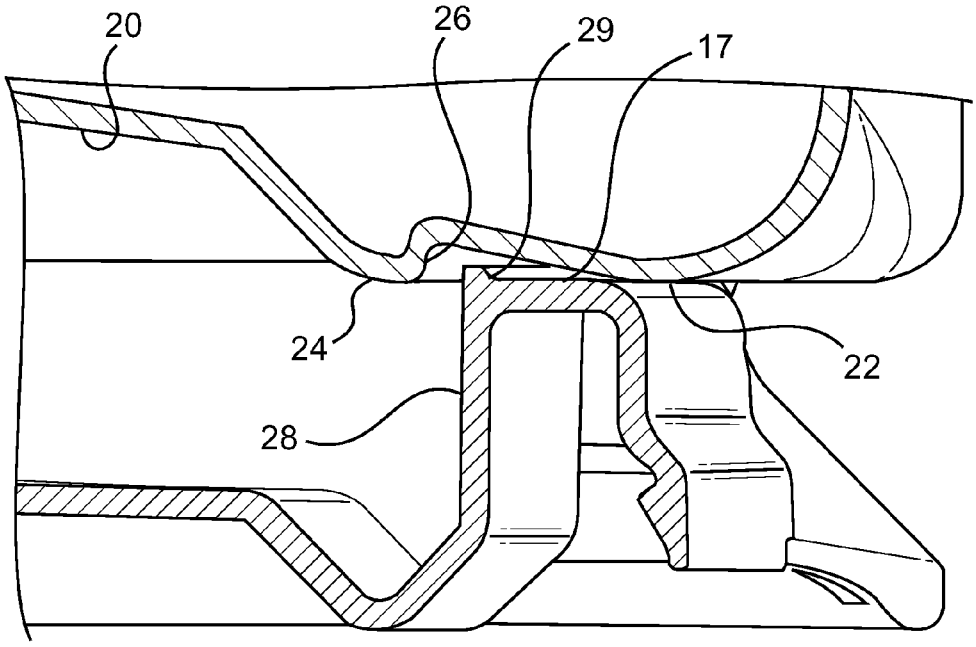
FIG. 2 is a fragmentary cross-sectional view depicting an enlarged portion of an area that is shown in FIG. 1.
Figure 3:
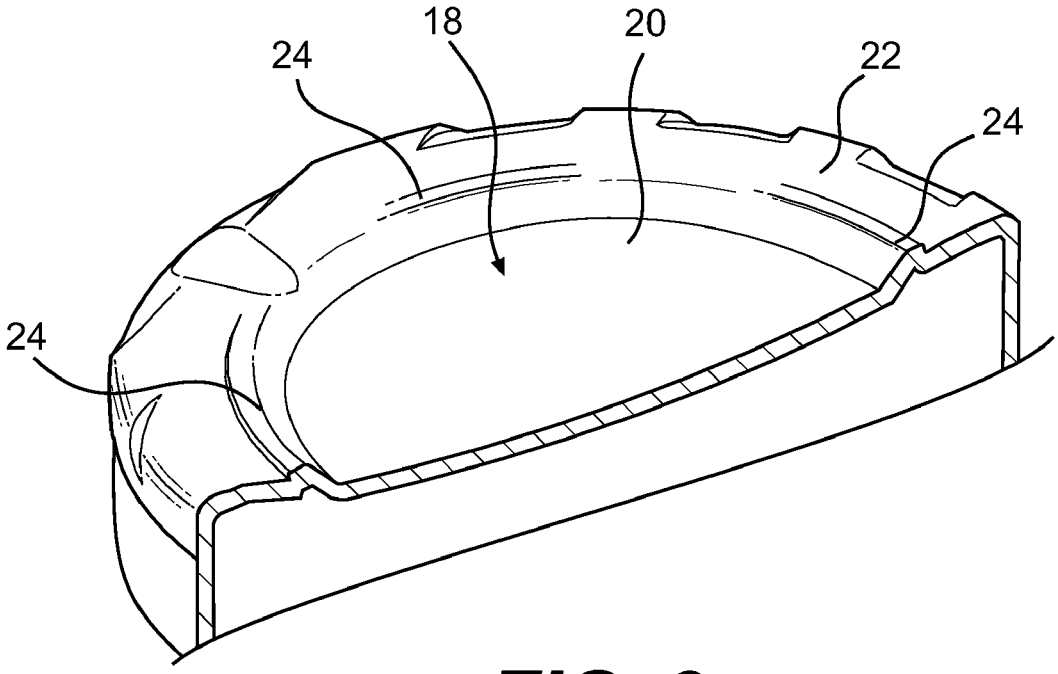
FIG. 3 is a perspective fragmentary cross-sectional view showing a bottom portion of the container assembly that is constructed according to a preferred embodiment of the invention.

As is best shown in FIG. 2, each projection 24 includes a first contact surface 26 on a radially outer side thereof. The first contact surface 26 has a vertical component, and in the preferred embodiment preferably has a surface that is within 30° of a vertical plane. The upstanding rim portion 16 includes a second contact surface 28 on a radially inner side thereof that also has a vertical component. Preferably, the second contact surface 28 has a surface that is within 30° of a vertical plane. The container assembly 10 is configured so that the first contact surface 26 is immediately adjacent to the second contact surface 28 on an underlying container assembly 10 when the container assembly 10 is stacked on top of another container assembly 10.

In the preferred embodiment of the invention that is shown in FIG. 2, the upstanding rim portion 16 includes an abutment projection 29 that extends upwardly from the upper surface 17 in an area that is near a radially inner edge of the upper surface 17. The abutment projection 29 ensures that there will be sufficient contact between the upstanding rim portion 16 and the projection 24 to ensure accurate registration between container assemblies 10 during stacking.

As may also be visualized by viewing FIG. 2, the upper surface 17 of the upstanding rim portion 16 and the support surface 22 are preferably configured so as to create a camming action that will induce the flexible bottom portion 18 to flex in a manner that will move the projection 24 downwardly and radially outwardly when the container assembly 10 is stacked on top of another container assembly 10.

Preferably, the upper surface 17 of the upstanding rim portion 16 is substantially flat, and the support surface 22 is convexly curved. When the convexly curved support surface 22 contacts the substantially flat upper surface 17, a camming or rocking action is created that urges the adjacent part of the flexible bottom portion 18, including the projection 24, to pivot about the point of contact will tend to move the projection 24 downwardly and radially outwardly toward the second contact surface 28 of the upstanding rim portion 16. The projections 24 will accordingly end up adjacent to the second contact surface 28 but will preferably not all be in contact with the second contact surface 28 after this movement. Some portions may make contact, but the primary function of the projections 24 is to be a positioning guide, which does not require continuous contact.

In the preferred embodiment, the support surface 22 extends downwardly beyond the projection 24 when the container assembly 10 is not stacked on top of another container assembly 10. Accordingly, when the container assembly 10 is placed on a flat horizontal surface it will be supported solely by the support surface 22, and the projections 24 will not make contact with the horizontal surface.

Alternatively, the projections 24 could be formed to extend downwardly in response to the weight of the container assembly to an extent where they will also make contact with the horizontal surface when sufficient weight is provided within the container assembly 10.

In another alternative embodiment, the support surface 22 will extend downwardly about the same extent as the projection 24 when the container assembly 10 is not stacked on top of another container assembly 10. The support surface 22 and the projection 24 would in this embodiment be positioned substantially within a common horizontal plane when the container assembly 10 is not stacked on top of another container assembly 10.

Figure 4:
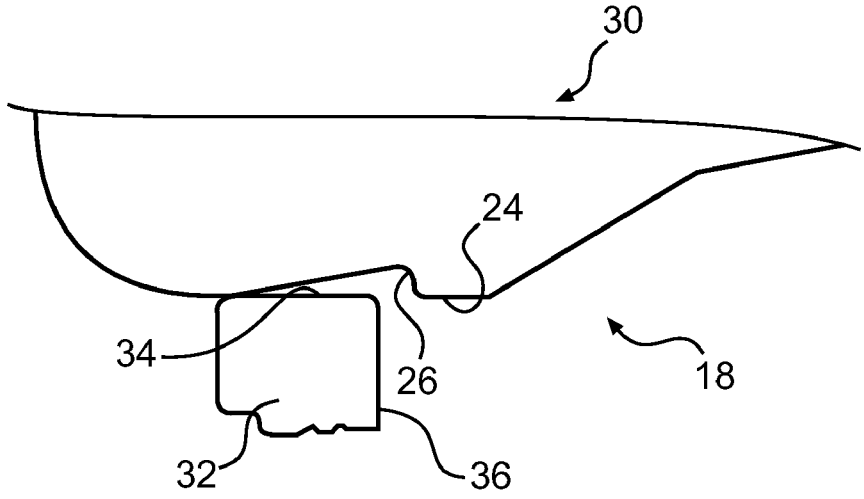
FIG. 4 is a diagrammatical view depicting a portion of a container assembly that is constructed according to an alternative embodiment of the invention.

Referring now to FIG. 4, a stackable container assembly 30 that is constructed according to an alternative embodiment of the invention is similar to the embodiment that is described above, but lacks an abutment projection such as that described in the foregoing embodiment that extends upwardly from the upper surface 17 in an area that is near a radially inner edge of the upper surface 17. Instead, the stackable container assembly 30 includes a removable lid that has an upstanding rim portion 32 having an upper surface 34 that is substantially flat. The upstanding rim portion 32 includes a second contact surface 36 on a radially inner side thereof that has a vertical component. Preferably, the second contact surface 36 has a surface that is within 30° of a vertical plane. The container assembly shown in FIG. 4 is configured so that the first contact surface 26 is immediately adjacent to the second contact surface 36 on an underlying container assembly when the container assembly is stacked on top of another container assembly 10.

Although in the preferred embodiments the upstanding rim portions are located on a removable lid, it should be understood that they could alternatively be part of the upper portion of the main body of the container.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A stackable container assembly, comprising:

a main body;

an upstanding rim portion having an upper surface; and a flexible bottom portion, said flexible bottom portion having a lower surface comprising at least one support surface for supporting said container assembly on a horizontal surface, said lower surface further comprising at least one projection that is disposed radially inwardly from said support surface, and wherein said flexible bottom portion is configured so that said projection will flex downwardly into a position that is adjacent to an upstanding rim portion of an underlying container assembly when said container assembly is stacked on top of another container assembly;

wherein said container assembly comprises a removable lid portion, and wherein said upstanding rim portion is located on said removable lid portion; and wherein said removable lid portion comprises a flexible diaphragm that is constructed and arranged to accommodate relative pressure changes between an interior of said container assembly and ambient conditions by flexing, whereby flexure of the rest of the container assembly as a result of such relative pressure changes is minimized.

2. A stackable container assembly according to claim 1, wherein said at least one projection comprises a plurality of projections.

3. A stackable container assembly according to claim 1, wherein said projection comprises a first contact surface on a radially outer side thereof, said first contact surface having a vertical component, and wherein said upstanding rim portion comprises a second contact surface on a radially inner side thereof, said second contact surface also having a vertical component, and wherein said container assembly is configured so that said first contact surface is immediately adjacent to a second contact surface on an underlying container assembly when said container assembly is stacked on top of another container assembly.

4. A stackable container assembly according to claim 1, wherein said upper surface of said upstanding rim portion and said at least one support surface are configured so as to create a camming action that will induce said flexible bottom portion to flex in a manner that will move said at least one projection downwardly and radially outwardly when said container assembly is stacked on top of another container assembly.

5. A stackable container assembly according to claim 4, wherein said upper surface of said upstanding rim portion comprises an area that is substantially flat.

6. A stackable container assembly according to claim 4, wherein said at least one support surface comprises an area that is curved.

7. A stackable container assembly according to claim 6, wherein said area that is curved is convexly curved.

8. A stackable container assembly according to claim 1, wherein said at least one support surface comprises a substantially continuous standing ring.

9. A stackable container assembly according to claim 1, wherein said at least one support surface extends downwardly beyond said projection when said container assembly is not stacked on top of another container assembly.

10. A stackable container assembly according to claim 1, wherein said upstanding rim portion comprises an abutment projection that extends upwardly from said upper surface, said abutment projection being located near a radially inner edge of said upper surface.

11. A stackable container assembly according to claim 1, wherein the main body, the upstanding rim portion and the flexible bottom portion are unitary with each other and fabricated from a plastic material.

* * * * *